United States Patent [19]

Nagai et al.

[11] Patent Number: 4,564,432

[45] Date of Patent: Jan. 14, 1986

[54] APPARATUS FOR RECOVERING METALS DISSOLVED IN A SOLUTION

[75] Inventors: Hiroshi Nagai; Yoshinori Kanno, both of Yokohama, Japan

[73] Assignee: Nanao Kogyo Co., Ltd., Yokohama, Japan

[21] Appl. No.: 516,793

[22] Filed: Jul. 25, 1983

[51] Int. Cl.[4] ..... C25D 21/18; C25C 7/08; C25C 1/20

[52] U.S. Cl. ..... 204/237; 204/257; 204/263; 204/109

[58] Field of Search ..... 204/DIG. 13, 252, 263, 204/237, 109, 255-258

[56] References Cited

U.S. PATENT DOCUMENTS 1,590,596 6/1926 Taylor et al. ..... 204/237 X
3,915,822 10/1975 Veltman ..... 204/151
3,954,594 5/1976 Recht ..... 204/263
3,977,951 8/1976 Lopez-Cacicedo ..... 204/263 X
4,202,752 5/1980 Sherwood et al. ..... 204/263 X

FOREIGN PATENT DOCUMENTS 2062083 6/1972 Fed. Rep. of Germany ..... 204/263

*Primary Examiner*—Donald R. Valentine
*Attorney, Agent, or Firm*—Donald D. Mon; David O'Reilly

[57] ABSTRACT

An apparatus for recovering metals, such as gold and silver, dissolved in a solution, such as plating waste, rapidly and effectively, comprising a collector (electrolyzing device) for depositing metals in a solution on conductive particles, and a plating device (electrolysis recovering device) for recovering the metals in the form of plating.

4 Claims, 3 Drawing Figures

APPARATUS FOR RECOVERING METALS DISSOLVED IN A SOLUTION

BACKGROUND OF THE INVENTION

This invention relates to an apparatus for recovering metals dissolved in a solution, and more specifically relates to an apparatus for recovering gold or silver from the solution. 98 more particularly relates to an apparatus for recovering gold or silver in a solution rapidly and efficiently, provided with electrolyzing device(collector) and an electrolysis recovering device (plater).

Various solution having metals especially gold or silver, such as gold or silver plating wastes which are often subjected to recovering treatments so as to permit re-use these precious metals. In conventional treatments, however, a large scale apparatus is required for treatment, at very long times and at large cost.

The inventors of the present invention developed an apparatus which having a collector for depositing of metals in a solution on conductive particles, and a plater for recovering said metals.

SUMMARY OF THE INVENTION

Accordingly, it is an object of this invention to provide an apparatus for recovering metals dissolved in a solution rapidly and efficiently. According to the invention, these and further objects can be accomplished by providing an apparatus for recovering metals dissolved in a solution which comprises an electrolyzing device and a recovering device. The electrolyzing device consists of an electrolytic cell, a diaphragm which divides said electolytic cell into an anode compartment, and a cathode compartment, a main anode and a main cathode disposed in said anode and cathode compartment, respectively. A mixture of conductive and non-conductive particles packed in each compartment, said conductive particles is being arranged in each compartment to possess the same polarity as that of said main anode or main cathode without causing bipolarization. The metals dissolved in the solution are deposited on said conductive particles by the electrode reaction of said solution, and said recovering device by electrolysis. A dissolving chamber for dissolving the metals deposited on the particles into an aqueous solution of cyanide in the presence of air is provided and an electrolyzer provided with an anode and includes a cathode, for recovering the metals in the aqueous solution of cyanide on said cathode by electrolyzing said aqueous solution in which the metals are dissolved.

DETAILED DESCRIPTION

Figure 1:
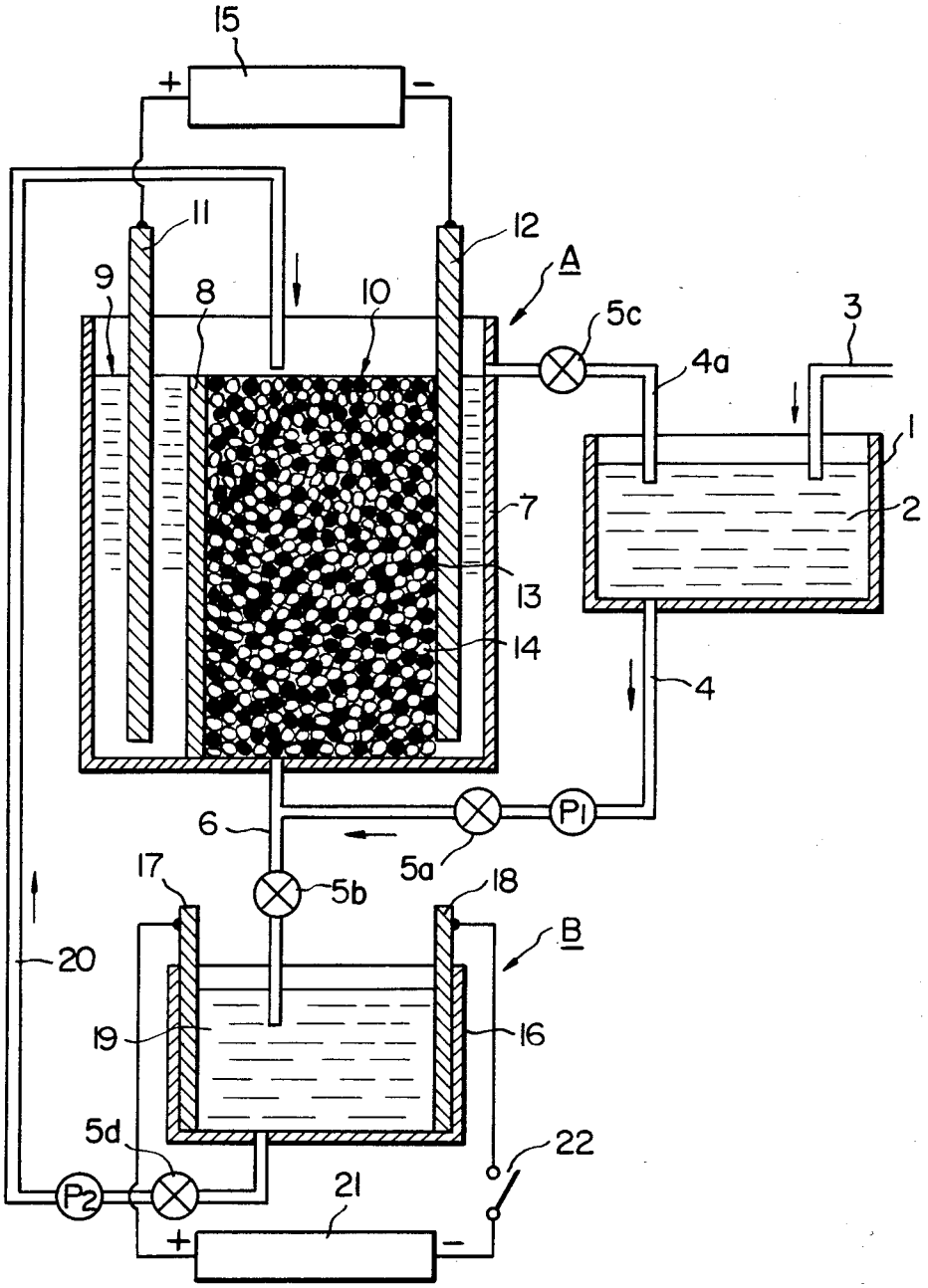
FIG. 1 shows a cross-sectional view of an embodiment of the present electrolyzing device.

In considering the accompanying drawing, reference is first made to FIG. 1 which is a cross sectional view of a preferred embodiment of the present apparatus.

In FIG. 1, A is an electrolyzing device (collector) and B is an electrolysis recovering device (plater) which are explained in detail hereinafter, respectively.

(A) Electrolyzing device

In an electrolytic cell 7, diaphragm 8 is disposed to divide cell 7 into an anode compartment 9 and a cathode compartment 10. Although any conventional diaphragms, ion-exchange membranes, plate made of porous synthetic resin, ceramics or biscuit, synthetic cloth, and the like may be used for diaphragm 8, wood plates such as cypress are desirably employed to produce the deposition of metals effectively. Laminated plates made by combining, for example, two kinds of plates are also used as diaphragm 8.

A main anode 11 and a main cathode 12, made of graphite and sometimes called the main electrodes, are disposed in anode compartment 9 and cathode compartment 10, respectively. Both compartments 9 and 10, or at least cathode compartment 10 are packed with a mixture of conductive particles 13 and non-conductive particles 14. They are mixed and arranged in compartments 9 and 10 so that the conductive particles are in contact with each other to form various lengths of conductive chains extending from the main electrodes. The longer the chain is, the greater its electric resistivity. Such arrangement expands the effective area of the electrode reaction and the conductive particles take part in the reaction while possessing the same polarity as each main electrode without causing bipolarization.

Optimum conductions for electrolysis will be obtained by selecting suitable particle sizes and materials for the conductive and non-conductive particles, constituent of the mixture, based on the properties of the electrolytic solutions to be treated.

The conductive particles 13 include many conventional particulate materials such as particulate graphite, particulate metals or alloys which are stable to the electolytic solutions. The non-conductive particles 14 include glass beads, silica gel, particulate synthetic resins, particulate ion-exchange resins, and ceramic particles.

When the electrode reactions are carried out in electrolyzing device A of this invention, the electrolyte, i.e. the solution to be treated, is fed through the mixture of the conductive and non-conductive particles continuously or batchwisely while an electric current passes from outer-power source 15 through the solution. Thus, the oxidation reaction in the anode compartment and the reduction reaction in the cathode compartment are performed effectively without causing bipolarization.

When a solution containing dissolved metals, such as gold and silver is passed through cathode compartment 10, and electrode reaction of the solution is carried out in cathode compartment 10. The gold and silver in the solution are respectively electrodeposited on conductive particles 13.

Many reaction systems may be treated by the device of this invention. For example:

Anode reactions $$X^- + 4OH^- - 6e \rightarrow XO_3^- + 2H^+ + H_2O$$

$$XO_3^- + H_2O - 2e - XO_4^- + 2H^+$$

where X means halogen $$2SO_4^{2-} - 2e \rightarrow S_2O_8^{2-}$$

$$MnO_4^{2-} - e \rightarrow MnO_4^-$$

$$2Cr^{3+} + 8H_2O - 6e \rightarrow 2CrO_4^{2+} + 16H^+$$

$$Pb^{2+} - 2e - Pb^{4+}$$

$$Mn^{2+} - 2e - Mn^{4+}$$

are oxidation reactions of organic compounds using $V^{5+}$, $Mn^{2+}$ $Ce^{4+}$, and $Cr^{6+}$ as the oxygen carrier, Kolbe reaction, and decomposition of organic halogenated cyano compounds.

Cathode reactions $$U^{6+} + 2e \rightarrow U^{4+}$$

$$Cu^{2+} + e \rightarrow Cu^{+}$$

$$M^{n+} + ne \rightarrow M$$

(where, M is selected from Zn, Fe, Ni, Sn Pb. Cu, Hg, Ag, Pt, Au, Cd, and the like):

Carbonyl compounds→alcohols:

Nitro compounds→Amino compounds:

Hydrogenation of unsaturated compounds:

Hydrogenation of nitriles:

Hydrogenation of amino compounds.

Accordingly, it is apparent from the examples of reactions listed above that device A of this invention is usefull for detoxicating or removing toxic components in servive water or waste water, and is applicable to primary and secondary batteries.

If only the conductive particles are used to increase the reactive area of the electrodes, the closer to each counter electrode the particles are placed, the more highly they should be polarized. This results in a violent reaction and higher current density around the particles close to their counter electrodes, and does no increase the reactive area of the electrodes remarkably. Therefore, according to device A of this invention, sufficient non-conductive particles are mixed to the conductive ones to form the various counter electrodes. The electric resistance of the particles increase with their chain length, which makes it possible to perform an almost homogeneous reaction on the conductive particles in the cell and increase the reactive area of the electrode effectively. It is noted, however, that connections between the conductive particles are insulated and that undesirable bipolarization would appear thereby causing a reduction-oxidation reaction on both sides of the same particle, when excess non-conductive particles are added.

As described before, materials of the diaphragm which may be used in device A of this invention include synthetic cloths, biscuit, porous synthetic resin, and asbestos. When synthetic cloths or porous synthetic resins are used to electrolyze a solution and electrodeposit a metal ion on the cathode, however, the metal deposited continues to grow towards the anode, penetrates the diaphragm, and finally short-circuits the cathode and the anode to decrease the electrolysis efficiency. On the other hand, in the case of biscuit, the diaphragm tends to be damaged easily short-circuiting both electrodes due to the particles packed in the cell. These problems are solved by the use of a wood plate as the diaphragm which assures an effective electrode reaction. The wood plate is very usefull to electrodeposit metals thereon, can withstand relatively slight impact and thus it is especially well suited for industrial use. When the surface of a swelled wood plate in the electrolytic solution is scratched, it may be laminated with the synthetic cloths.

As described hereinabove, the arrangement of the conductive and non-conductive particles in device A of this invention as shown in FIG. 1 results in an expanded reaction area wherein conductive particles, as a whole, take part in electrolysis effectively and uniformly, and there is sufficient electric potential to perform exellent oxidation and reduction. These are an improvement over conventional ones. Further, while diaphargm 8 is disposed between main anode 11 and main cathode 12 to divide the cell 7 into two compartments 9 and 10, the oxidation and reduction reactions can be carried out independently in each compartment. It is not necessary to dispose the counter electrodes apart from the particles, and in fact this makes the present device compact.

The following examples are given by way of illustration but are not to be construed to limit the scope of this invention.

EXAMPLE 1

An electrolytic solution containing 200 g/l of sulphric acid and 5 g/l of copper ion ($Cu^{2+}$) was subjected to the cathode reaction to deposit metallic copper by employing device A of this invention and following known packed bipolar cells under the same conditions. These known cells were packed with active carbon (hereinafter called "cell A"), graphite (hereinafter called as "cell B") and a mixture thereof (hereinafter called "cell C"), respectively.

In device A of this invention, the electrolytic cell, made of polyvinyl chloride, of 70×70×100 (height) mm was divided by a knotless cypress plate of thickness 5 mm into a compartment X of 70×50×100 mm and a compartment Y of 70×20×100 mm, and two graphite plates of 66×100×5 (thickness) mm as electrodes were placed at both ends of compartments X and Y. A mixture containing crushed graphite 2 to 3 mm in diameter and glass beads 3 mm in diameter in the volume ratio of 6:4 was packed in both compartments. The electrolytic cell was charged with 100 ml of the solution to be treated, and then an electric current of 1 A was passed for fifty minutes through compartments X and Y as the cathode and anode, respectively.

Each cell A, B and C, similarly sized as that one described above and made of polyvinyl chloride, was provided with a pair of graphite plates of 65×100×5 (thickness) mm as electrodes at both ends thereof, and was packed with spherically active carbon 3 mm in diameter, crushed graphite particles 2 to 3 mm in diameter and a mixture containing the latter and polyvinyl chloride pellets of 3 mm in diameter thereinto, respectively, to constitute the packed bipolar cell. The volume ratio of graphite particles to the polyvinyl chloride pellets packed in cell C was controlled to about 1:3 because the bipolarization occurred around said mixing ratio. These cells were charged with 100 ml of the electrolytic solution to be treated respectively with an electric current of 1 A was passed for fifty minutes through each electrode.

The results obtained by the electrode reaction using four different cells are shown in Table 1.

TABLE 1

Copper deposited in different cells

| Cell | Copper deposited (mg) |
|---|---|
| present device | 468 |
| cell A | 165 |

TABLE 1-continued

| Copper deposited in different cells | |
|---|---|
| Cell | Copper deposited (mg) |
| cell B | 22 |
| cell C | 265 |

It is apparent from Table 1 above that the electrolyzing process using device A of this invention gives metalic copper far more effectively in comparison with those processed using conventional packed bipolar cell (e.g. British Pat. Nos. 1,279,650 and 1,362,704, Germany patent publication No. 2,148,402). Further, the present device is more compact or of smaller size than any conventional cells.

EXAMPLE 2

Device A of this invention described in example 1 was charged with 100 ml of an electrolytic solution containing 200 g/l of glucose, 150 g/l of potassium carbonate and 25 g/l of bromine. The temperature of the solution in the cell was kept at 23° to 25° C. and an electric current of 3 A was passed for thirty minutes through the electrodes wherein compartments X and Y were used as the anode and the cathode, respectively, i.e. the current was passed in the opposite direction of the cathode reaction of example 1. After the reaction was completed, 6.5 g of potassium gluconate was recovered.

It should be understood that device A of this invention is preferably used for oxidation of many organic compounds, too.

EXAMPLE 3

In this example, a relationship between the mixing ratio of the particles packed in the cell and the electrolying efficiency was discussed. The cathode reaction $Cu^{2+}+2e \rightarrow Cu$ was carried out using the same device and electrolytic solution as example 1. The content of the graphite particles and the glass beads in the mixture was varied from 0 to 100% and 100% to 0% by volume, respectively. An electric current of 2 A was passed for thirty minutes. The result obtained is shown in FIG. 2.

Figure 2:
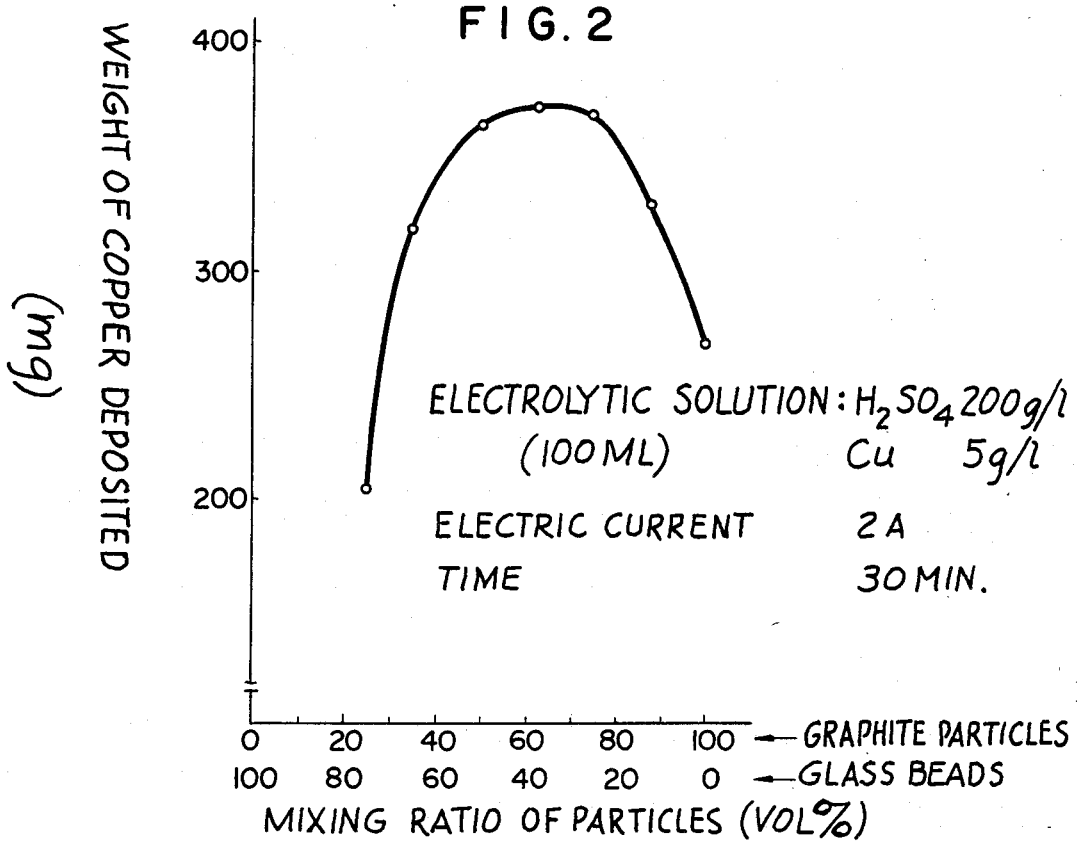
FIG. 2 show a relationship between the mixing ratio of particles and the weight of copper deposited.

It is apparent from FIG. 2 that metallic copper is deposited most effectively at the mixing ratio (volume) of graphite to glass beads ranging from 1:1.5 to 1.5:1. And further, such preferred ratio makes the device compact.

EXAMPLE 4

Figure 3:
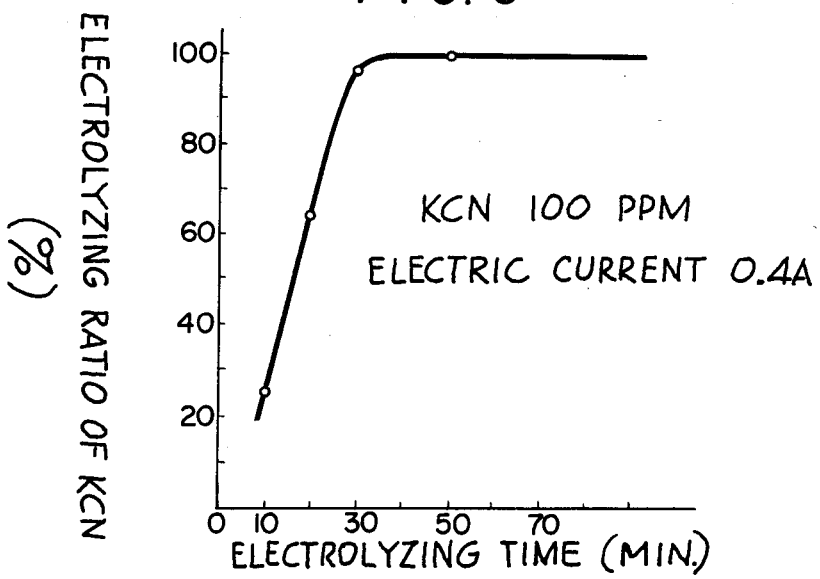
FIG. 3 shows a relationship between the electolyzing time and the electrolyzing ratio of KCN.

A solution of potassium prussiate (KCN 100 ppm; 100 ml) was electrolyzed to detoxicate in device A of this invention in which a 1, 1 mixture of crushed magnetite of 2 to 3 mm in diameter as the conductive particles and polyvinyl chloride pellets of 2 to 3 mm in diameter were packed. An electric current of 0.9 A was passed in the opposite direction of the reaction of example 1. A relationship between the electrolyzed KCN and the electrolyzing time is shown in FIG. 3, It is found that a dilute solution of KCN, which was not able to be treated by conventional cells because of its low concentration, is effectively electrolyzed.

EXAMPLE 5

Saran ® Cloth (1 mm thick) and a knotless cypress plate (5 mm thick) were used as the diaghragm in device A of this invention to divide the cell into the anode compartment of 30 l and the cathode compartment of 70 l. A 5000 l of solution containing 5 g/l of Ag and 50 g/l of KCN was circulated through the compartment to recover metallic silver. Both runs were continued for 300 hours while passing an electric current of 100 A. The result obtained is shown in Table 2.

TABLE 2

| diaphragm | Ag deposited (Kg) | Short circuit between electrodes |
|---|---|---|
| cypress plate | 24.87 | no |
| Saran ® cloth | 3.2 | within 30 hrs. |

It is noted that the electrolyzing efficiency in reaction described above highly depends upon the material to be used as the diaphragm.

(B) Electrolysis Recovering Device

This device comprises an electrolyzer 16 and a dissolving chamber, and in the embodiment of FIG. 1, the dissolving chamber is cathode compartment 10 of electrolyzing device A, but of course other suitable dissolving chambers can be used instead of cathode compartment 10.

In the dissolving chamber(cathode compartment 10), the metals deposited on conductive particles 13 are dissolved into an aqueous solution of cyanides in the presence of air. The aqueous solution of cyanides is supplied to electrolyzer 16 through pipe 6. Electrolyzer 16 is provided with an anode 17 and a cathode 18 on both side walls thereof, and recovers metals in aqueous solution of cyanides 19, dissolved at the dissolving chamber, by electrolysis in the form of a plate on cathode 18.

The apparatus of the present invention can be provided, if necessary, with tank 1 for a storing metal dissolving solution, such as plated wastes in addition to said electrolyzing device A and electrolysis recovering device B. Tank 1 is connected with cathode compartment 10 by pipes 4, **4*a* to circulate said solution from tank 1 through cathode compartment 10 to tank 1**.

Electrolyzer 16 is connected with cathode compartment 10 by pipe 20 to circulate aqueous solution of cyanides 19 from electrolyzer 16 through cathode compartment 10 to electrolyzer 16.

In FIG. 1, $p_1$, $p_2$, and $p_3$, respectively, indicates pumps, **5*a*, 5*b*, 5*c* and 5*d*, respectively, indicates valves, numeral 21 indicates outer power source, and numeral 22** indicates a switch.

The present invention described above is carried out by the following steps.

First of all, valves **5*b* and 5*d* are closed and valves 5*a* and 5*c* are opened, and then, plated wastes 2 having dissolved gold or silver therein, is introduced in tank 1. Pump 1 circulates plated wastes 2 from tank 1 through pipe 4, cathode compartment 10 and pipe 4*a* to tank 1, and at the same time, outer power source, 15 is "ON". As a result, plated wastes 2 are subjected to an electrode reaction at cathode compartment 10 to deposite gold or silver from plated wastes 2 on conductive particles 13**.

Then, pump $P_4$ is stopped, and valves **5*a* and 5*c* closed. After residual wastes in electrolytic cell 7 are discharged through drain cock (not shown in FIG. 1), valves 5*b* and 5*d* are opened and pump $p_2$ circulates aqueous solution of cyanides 109 in electrolyzer 16 through pipe 20, cathode compartment 10 and pipe 6 to electrolyzer 16**.

The aqueous solution of cyanides 19 is conducted from pipe 20 into cathode compartment 10 by showering or spraying the aqueous solution of cyanides on particles 13, 14. If the chamber is opened to the air at its upper end, the particles 13 are wetted by the aqueous solution in the presence of air. That is to say, the particles 13 in contact with air under a wetting condition, and air acts as an oxidizing agent which contributes to a rapid dissolution of deposited gold and silver on the particles 13 into the aqueous solution of cyanide. Accordingly, the aqueous cyanide is the only dissolving solution employed in device B of this invention, which dissolves gold and silver rapidly and effectively. Various cyanides, such as sodium cyanide and the like, may be used as a dissolving solution of this invention.

The aqueous solution of cyanide containing dissolved gold and silver is introduced to electrolyzer 16 from the bottom of dissolving chamber 10. The electrolyzer 16 has anode 17 and cathode 18 on its side walls. When the concentration of gold and silver in the solution increases enough to electrolyze, outer power source 21 is activated by switch 22, and both metals in the solution are recovered on cathode 18 as a fine metallic plating, while a gas predominantly consisting of oxygen is generated from anode 17. Grahite is mainly employed as anode 17 and stainless steel as cathode 18.

After the aqueous solution is treated in the electrolyzer to recover gold and silver, it is supplied to cathode compartment 10 by means of pump $p_2$ disposed at an appropriate position on pipe 20, and is reused to dissolve gold and silver. As descrived above, the aqueous solution of cyanide is reusable which results in an economical treatment of gold and silver deposited on the materials without any undesirable waste water or environmental pollution.

This invention will be more fully understood by following examples.

EXAMPLE 1

The experiment was carried out by using the apparatus described in FIG. 1.

First of all, valves 5*a* and 5*b* are closed, and valves 5*a* and 5*c* are open, introducing gold plated waste into tank 1. Pump 1 circulates gold plated waste 2 from tank 1 through pipe 4, cathode compartment 10 and pipe 4*a* to tank 1, and at the same time, outer power source 15 is "ON". As a result, gold plated waste 2 is subjected to electrode reaction at cathode compartment 10 to deposite gold from gold plated waste 2 on conductive particles 13.

Then, pump $P_1$ is stopped, and valves 5*a* and 5*c* are closed. After residual waste in electrolytic cell 7 is discharged through a drain cock (not shown), valves 5*b* and 5*d* are opened and pump $p_2$ is operated to shower 50 g/l solution of NaCN on to particles 13, 14 in cathode compartment 10 at a spraying rate of 10 ml/mim.

Two plates of stainless steel and graphite, 1 $dm^2$ each, were used as cathode 17 and anode 18 respectively. Turning on switch 22 applies an electric current of 0.3 A to the electrolyzer 16. After 3 hours, gold was deposited effectively on cathode 18.

EXAMPLE 2

The experiment was carried out with the same conditions as Example 1 except using silver plated waste instead of gold plated waste. After 3 hours, all silver on particles 13 was dissolved and was deposited effectively on cathode 18 of electrolyzer 16.

EXAMPLE 3

In the example, the dissolving rate of silver was tested. When particles on which silver was deposited was treated by the same procedure as Example 1, the dissolving rate was 21 micron/hr. at a temperature of 20° C. While, for silver dissolved in an aqueous solution of sodium cyanide, conventionally used for silver smelting, with air blowing, the dissolving rate decreased to about one fifth of the present process.

Thus, it is clear that silver is dissolved more rapidly than in the conventional air blowing process.

We claim:

1. An apparatus for recovering metal in a solution comprising:

an electrolyzing depositing device means comprised of an electrolytic cell, a diaphragm dividing said cell into compartments, electrodes comprising a main anode and main cathode disposed in each respective compartment, a mixture of conductive and non-conductive particles in each of said compartments, said conductive particles being arranged in each compartment to have the same polarity of said electrodes in each respective compartment without causing bipolarization, a power source for applying an electric current through said electrolytic cell to deposit said metals dissolved in said solution on said conductive particles by reaction of said solution with said electrodes;

a dissolving chamber having an aqueous solution of cyanide for dissolving said metals deposited on said particles in the presence of air, said dissolving chamber being formed by adding said aqueous solution of cyanide to said cathode compartment of said electrolyzing depositing device means, said cathode compartment being open to the air;

an electrolyzer recovering device means having an anode and a cathode for recovering said metals dissolved in said aqueous solution of cyanide, a second power source for applying a current to said electrolyzer recovering device means to electrolize said aqueous solution of cyanide, said metals being recovered on said cathode of said electrolyzer recovering device means; and pipe means connecting said dissolving chamber to said electrolyzer recovering device means whereby said aqueous solution of cyanide containing said dissolved metals is introduced into said electrolyzer recovering device means from said dissolving chamber through said pipe means.

2. The apparatus according to claim 1 including a storage tank for storing said solution containing dissolved metals, said storage tank being connected by pipes for circulating said solution through said cathode compartment and back to said storage tank.

3. The apparatus according to claim 1 wherein said electrolyzer recovering device means is connected with said cathode compartment dissolving chamber by pipes for circulating said aqueous solution of cyanide from said electrolyzer recovering device means to said cathode compartment dissolving chamber and back to said electrolyzer recovering device means.

4. The apparatus according to claim 1 wherein said metals being recovered are from the group consisting of gold and silver.

* * * * *